US005197923A

United States Patent [19]

Barber

[11] Patent Number: 5,197,923

[45] Date of Patent: Mar. 30, 1993

[54] FLOATING AND DISEMBARKING PLATFORM

[76] Inventor: Gerald L. Barber, 10 Whittington Ct., Greenville, S.C. 29615

[21] Appl. No.: 768,381

[22] Filed: Sep. 30, 1991

[51] Int. Cl.[5] ..... A63G 3/00

[52] U.S. Cl. ..... 472/13; 104/86

[58] Field of Search ..... 472/13.1, 117; 104/58-73, 86

[56] References Cited

U.S. PATENT DOCUMENTS

| | | | |
|---|---|---|---|
| 1,099,899 | 6/1914 | Trostler | 472/13 |
| 1,357,995 | 11/1920 | Kitterman | 472/13 |
| 1,689,138 | 10/1928 | Hire | 472/13 X |
| 3,125,339 | 3/1964 | Nielsen | 472/13 |
| 3,451,673 | 6/1969 | Mattson | 472/13 X |
| 4,836,521 | 6/1989 | Barber | 472/13 |

*Primary Examiner*—Richard E. Chilcot, Jr.
*Attorney, Agent, or Firm*—Dority & Manning

[57] ABSTRACT

A loading platform for loading and disembarking passengers from floating carriers that includes a circular container filled with water to a predetermined level. A large driven disk rotatably supported at an angle so that the cars can be forced onto a submerged side of the disk and rotated out of the water so that the passengers can be loaded and disembarked from the carriers. The flow of the water through flumes and the disk aids in loading and removing the carriers from the disk.

2 Claims, 2 Drawing Sheets

FLOATING AND DISEMBARKING PLATFORM

BACKGROUND OF THE INVENTION

The present invention relates to a loading platform and more particularly, a loading platform for loading and disembarking passengers from floating carriers forming part of an amusement ride.

An important feature of amusement rides is the safe and efficient loading and unloading of passengers into and from the passenger carriers. In the past, on amusement rides wherein passengers were transported in boat-like structures, it was common practice to bring the carrier to a loading or disembarking station, stop the carrier and hold it in a stationary position while the passengers were being loaded into the carrier. Where the carrier was floating during this period of time, movement was imparted to the carrier by the passengers getting in an out of the carrier. This, of course, was undesirable due to the instability of the vehicle. In attempts to stabilize the carrier during the loading and unloading, it has been anticipated that the carriers would be raised on a rotating disk which lifts the boat-like structure out of the water so that it would be supported on a stationary surface. While it was being transported on the stationary surface, passengers could step into and out of the carrier.

One example of an amusement ride using carriers that float on water and permit the loading and unloading of passengers from a vehicle is disclosed in U.S. Pat. No. 4,838,521. Another example of an inclined rotary water platform is disclosed in U.S. Pat. No. 1,689,138. In this particular patent, there is disclosed an amusement device adapted for use by bathers at bathing places or at amusement places wherein as a result of the nature of the rotary platform being set in an oblique plane, bathers could be selectively deposited and removed from a body of water.

Accordingly it is a principle object of the present invention to control the movement of cars so that they can be loaded on a rotary platform in a uniform and spaced manner by the flow of water passing through flumes.

Another important object of the present invention is to provide a very safe and reliable method for loading passengers into floating carriers on amusement rides.

Still another important object of the present invention is to provide a very simple and efficient mechanism for loading passengers into boat-like structures while the boat-like structures are on solid surfaces and then depositing the boat-like structure back into a moving body of water.

SUMMARY OF THE INVENTION

This invention pertains to a loading platform for loading and disembarking passengers from floating carriers forming part of an amusement ride. The apparatus includes a circular container filled with water to a predetermined level. A large disk is rotatably carried in said circular container and has a supporting surface constructed of water permeable material so that water will pass readily therethrough. The circular disk has a large hole provided in the center thereof through which a stationary loading and disembarking platform extends. The disk is supported on rollers at an oblique angle so that one edge of the disk is below water level and the other edge is above water level. As a result, when the disk is rotated, it will lift the floating carriers from the water to a position above the upper surface of the water so that passengers can be readily loaded into and removed from the carriers.

Entrance and exit flumes are connected to the container so that water can be pumped into a container for propelling the floating carriers and for pushing the carriers onto and off of the rotating disk. Partitions are provided in the container for directing the flow of water from an entrance opening around the stationary loading and disembarking platform and out the exit opening. The level of the water in the container is of sufficient height so that moving water flows through a portion of the rotating platform for loading the carriers on the incline supporting surface as they pass through the entrance opening into the container. The moving water goes around the stationary loading platform and then passes back through the surface of the incline disk for lifting the carrier off the disk as it is rotated adjacent the exit opening in the containers.

The accompanying drawings, which are incorporated in and constitute a part of this specification, illustrate exemplary embodiments of the invention and together with the, invention, serve to explain the principles of the invention.

DETAILED DESCRIPTION OF THE PREFERRED EMBODIMENTS

Figure 1:
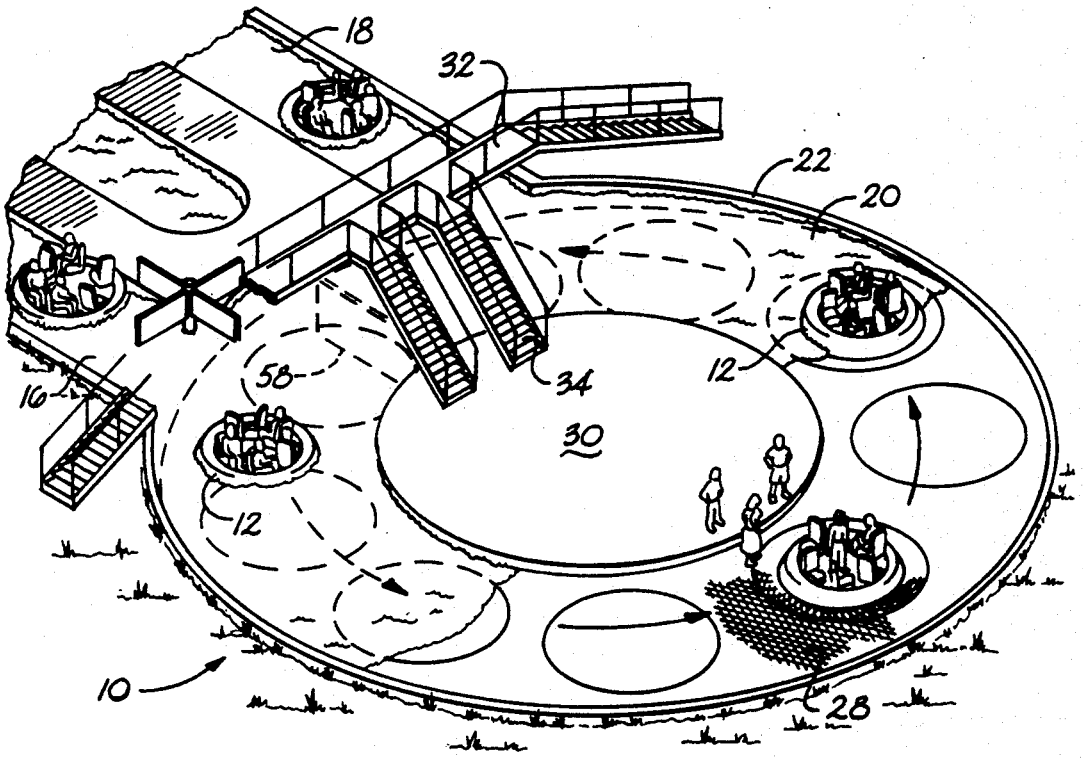
FIG. 1 is a prospective view illustrating a loading platform for amusement rides constructed in accordance with the present invention.
Figure 2:
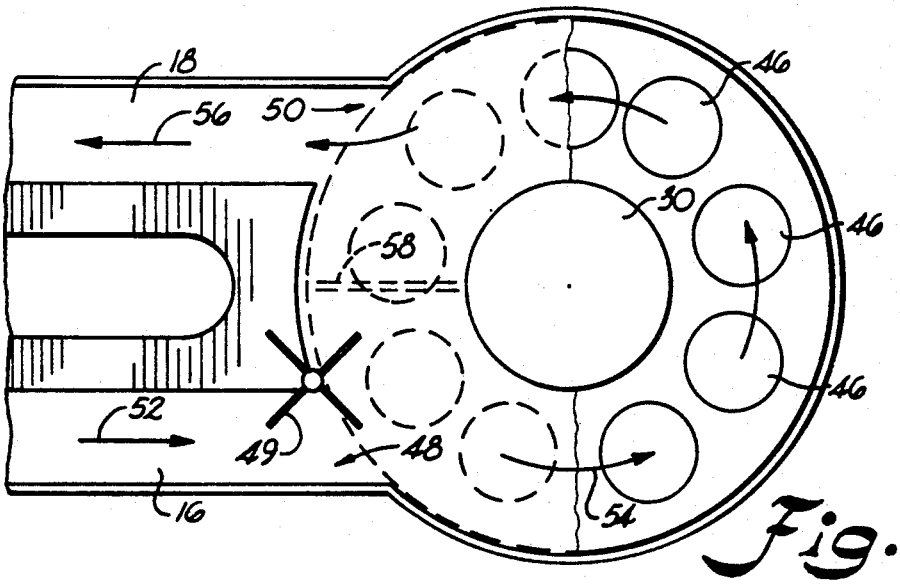
FIG. 2 is a schematic representation illustrating the manner in which the water flows in the loading platform of FIG. 1.
Figure 3:
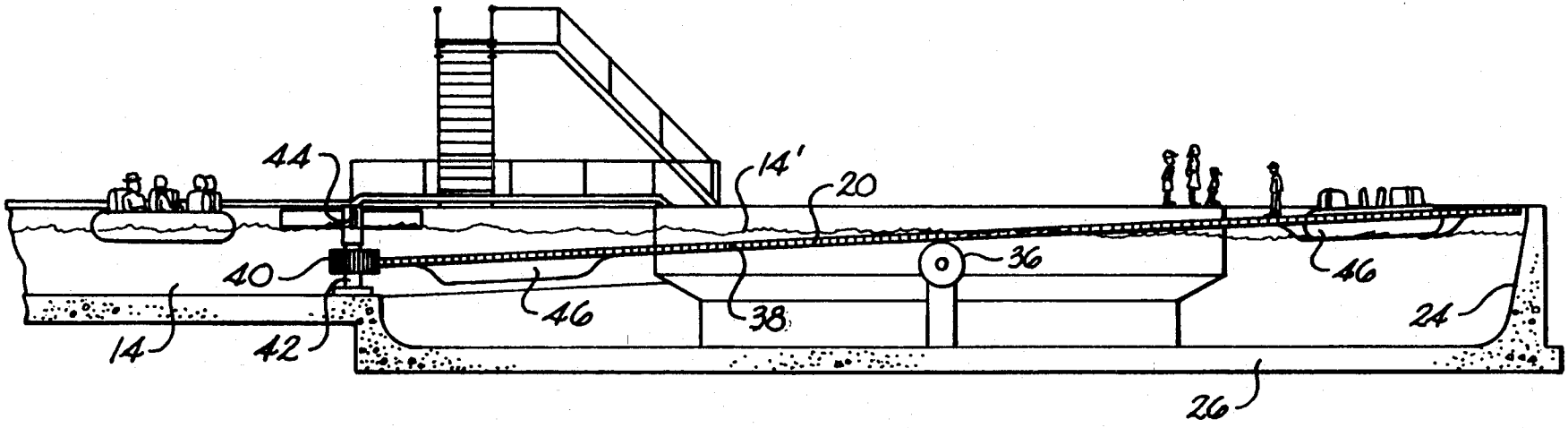
FIG. 3 is a side elevational view illustrating a loading platform constructed in accordance with the present invention.

Reference now will be made in detail to a preferred embodiment of the present invention, examples of which are illustrated in the accompanying drawings. As illustrated in FIGS. 1, 2 and 3, there is disclosed a loading platform generally designated by the reference character 10 that is adapted to be used with amusement rides wherein passengers are loaded into carriers 12 that are adapted to float on water as they pass through flumes 16 and 18 to the main portion of the ride. The particular loading platform can be used with many amusement rides, one such ride being disclosed in my earlier file, U.S. Pat. No. 4,836,521 entitled "Whirlpool Amusement Ride".

In order to load the passengers into the carriers 12 while the carriers are supported on a solid surface, an incline rotating disk 20 is utilized. The disk 20 is circular in shape and is carried within a container 22 that has side walls 24 and a bottom for receiving water. The container 22 may be constructed of any suitable material such as concrete and as shown in FIG. 1 is circular in shape.

The disk 20 has a supporting surface which is constructed of permeable material 28 such as a metal grate surface. The purpose of using a grate-type surface 28 is to permit water to pass readily therethrough.

The disk 20 has a circular hole provided in the middle thereof through which a fixed loading platform 30 extends. The loading platform 30 is stationary and projects above the surface of the disk 22.

Passengers desiring to be loaded into the carriers 12 enter the amusement ride from an overhead platform 32 which has stairways extending out to the sides of the ride. The overhead platform 32 also has stairways 34 providing access directly to the stationary centrally located platform 30.

The disk 20 upon which the passenger cars 12 are supported during the loading and unloading thereof is carried on suitable supporting rollers 36 shown schematically in FIG. 3. Any suitable supporting rollers may be used for supporting the disk at an oblique angle such as shown in FIG. 3 so that the leading edge of the disk, that is the edge closest to the flumes 16 and 18, is immersed under the level of the water whereas the upper edge of the disk as shown on the right-hand side in FIG. 3 is out above the water level 14'.

The disk 20 has teeth 38 provided in the periphery edge thereof which mesh with teeth 40 provided on a gear carried on vertically extending shaft 42. The vertically extending shaft 42 is driven by any suitable means such as an electric motor 44. When the shaft 42 is rotated, it rotates the gear 40 which in turn causes the disk 20 to rotate about the centrally located loading platform 30.

The disk has depressions 46 provided thereon into which the carriers 12 are deposited for being raised out of the water as shown on the right in FIG. 3.

The container 22 as best shown in FIG. 2 has an entrance opening generally designated by the reference character 48 and an exit opening generally designated by the reference character 50. The openings 48 and 50 are connected to the flumes 16 and 18 respectively.

A turn style 49 is carried in the entrance opening 48 for allowing the carriers to be fed to the rotating disk 20, one at a time.

The carriers 12 are moved through the flumes 16 and 18 by the flowing water 14. The water is moved in the direction of the arrows 52, 54 and 56 shown in Figure 2. Any suitable pumps can be utilized for moving the water in the direction of the arrows 52 and 56 through the flumes 16 and 18 respectively. A partition 58 is interposed between flumes 16 and 18 so that the water flows through the flume 16 through the perforated surface of the disk 20 around the stationary central platform 30 back through the perforated surface of the disk 20 to the exit flume 18.

As a result of the moving water and the rotation of the disk 20, the carriers 12 are loaded from the incoming flume 16, one at a time onto the indentions provided in the disk 20.

As the disk 20 is rotated, the carrier is lifted out of the water and the passengers can step out of the carriers onto the upper surface of the disk 20 onto the fixed platform 30. Such provides quick and safe access to the carriers.

It will be apparent to those skilled in the art that various modifications and variations can be made in the present invention without departing from the scope or spirit of the invention. Thus, it is intended that the present invention cover the modifications and variations of this invention provided they come within the scope of the appended claims and their equivalents.

What is claimed is:

1. A loading platform for loading and disembarking passengers from floating carriers forming part of an amusement ride comprising:

(a) a circular container filled with water to a predetermined level;

(b) a large disk carried in said circular container, said disk having a support surface constructed of water permeable material;

(c) means for rotating said disk at a predetermined speed;

(d) a large hole provided in the center of said disk;

(e) a stationary loading and disembarkation platform positioned in the center of said disk;

(f) means for supporting said disk at an angle permitting said water level to extend a predetermined distance over said support surface of said disk;

(g) an entrance and exit opening provided in said circular container;

(h) flumes connected to said entrance and exit openings providing ingress and egress to said supporting surfaces of said rotating disk carried in said container;

(i) means for supplying a flow of water to said entrance opening of said circular container; and (j) partitions provided in said container for directing said flow of water from said entrance opening around said stationary loading and disembarkation platform and out said exit opening, said predetermined level of water being of sufficient height so that said moving water flows through a portion of said rotating platform for loading said carriers on said inclined supporting surface as they pass through said entrance opening into said circular container and are removed from said supporting surface adjacent said exit opening permitting passengers access to said carriers as they are rotated on said disk.

2. The loading platform as set forth in claim 1 further comprising:

(a) depressions provided said supporting surface; and (b) a turn style directing said carriers to said depressions on said supporting surface as said carriers are transported through said entrance by said moving water.

* * * * *